US005398823A

United States Patent [19]

Anders

[11] Patent Number: 5,398,823

[45] Date of Patent: Mar. 21, 1995

[54] HOLDER AND STORAGE RACK FOR WRENCH SOCKETS

[76] Inventor: Stuart Anders, 3160 Pembroke Rd., Hallandale, Fla. 33009

[21] Appl. No.: 179,369

[22] Filed: Jan. 10, 1994

[51] Int. Cl.[6] ..... A47F 7/00

[52] U.S. Cl. ..... 211/70.6; 206/378; 248/309.2

[58] Field of Search ..... 211/69, 70.6, 94, 89; 248/309.2; 206/378, 493, 372, 373, 376, 377

[56] References Cited

U.S. PATENT DOCUMENTS

| | | | |
|---|---|---|---|
| 1,712,473 | 5/1929 | McWethy | 211/70.6 |
| 4,353,465 | 10/1982 | Rado | 211/70.6 X |
| 4,717,106 | 1/1988 | Bies et al. | 211/70.6 X |
| 4,826,021 | 5/1989 | Burrell | 211/70.6 |
| 4,840,342 | 6/1989 | Sweeny et al. | 248/345.1 X |
| 4,927,020 | 5/1990 | Randy | 206/378 |
| 5,228,570 | 7/1993 | Robinson | 206/378 |
| 5,301,822 | 4/1994 | Coleman et al. | 211/70.6 |

*Primary Examiner*—Ramon O. Ramirez
*Assistant Examiner*—Korie H. Chan

[57] ABSTRACT

A wrench socket holder and storage rack comprises a plurality of stud members registrable with a base member. Each stud member has three contiguous sections comprising two side sections and a top section hingedly connected from one side section to one edge of the top section and then from the other edge of the top section to the second side section. When the sides are positioned adjacent to one another, they form a stud having a substantially shaped square cross section. The interior surfaces of each side section of the stud member have a transverse bore, however, in one side section of the stud member, the bore is substantially completely through sufficient to allow a portion of a ball component to protrude therefrom yet be retained therein, while the second side section bore is partially therethrough, and along the same axis as the bore of the first side section, sufficient to house a coil spring member therein such that that member may be biased against the ball component when the sides are adjacent one another. The respective interior surfaces of the side sections have matable detent and recess means to releasably lock each of the side sections together.

6 Claims, 3 Drawing Sheets

HOLDER AND STORAGE RACK FOR WRENCH SOCKETS

BACKGROUND OF THE INVENTION

1. Field of Invention

This invention relates to the field of holders and storage means for wrench sockets. More particularly, the improved holder and storage rack for wrench sockets herein described comprises a novel stud or post member of convenient manufacture.

2. Description of the Prior Art

A ratchet or socket wrench is a tool that can accept sockets of varying sizes to drive a desired fastener. Only one socket is used during any one time with the socket wrench. Since sockets are often sold as sets, a problem exists with the storage of the unused sockets of the set.

In a typical socket set, since only one socket is used with the wrench at any given time, a number of free sockets remain. Heretofore, a user might place these free sockets in a toolbox to prevent loss of the individual sockets until the appropriately sized socket was needed for a particular job. However, as sockets are sized close together, this loosely packed, jumbled storage of sockets has made it difficult to choose the socket of desired size. Furthermore and oftentimes, sockets are easily lost in a conventional toolbox due to their lack of a specific retention device to hold the sockets in one particular place.

In order to overcome the problems of loosely packed, free sockets, a number of devices have been created to retain the unused sockets in a particular place. For example, in U.S. Pat. No. 1,712,473 to McWethy, an elongated flat bar having a number of solid posts for receiving the drive portion of a wrench socket is described. The posts are permanently affixed to one side of the bar and each post has a transverse bore which contains a pair of balls spaced by a coil. The balls are retained within the bore by peening each end thereof. U.S. Pat. No. 4,927,020 to Randy discloses another type of holder for socket wrench heads. This device incorporates a synthetic resin post or stud member that is slidably mounted into a channeled base member. The studs have no balls and coil, unlike McWethy aforementioned, and rely instead on a pressure fit with the socket head to be registered therewith. Also, in U.S. Pat. No. 5,228,570 to Robinson, a wrench socket storage rack with a quick release mechanism is taught. The quick release mechanism comprises, in part, a detent ball biased outwardly from a transverse bore in a stud which is peened to retain the ball within the bored stud. A release button permits the ball to fall into a recess thereby releasing the wrench socket which is in registry with the ball and stud member.

While the above mentioned prior art achieve the particular purposes to which they are addressed, they do not consider the overall manufacturing and assembling difficulties of their respective devices. Thus, it is a primary object of the present invention to provide a wrench socket storage rack that comprises a unique and novel stud member manufactured of a polysynthetic material employing a ball and coil that does not require peening.

It is another object of the present invention to provide a wrench storage rack comprising a unique and novel stud member that will be significantly less costly to produce.

It is still another object of the present invention to provide a wrench storage rack comprising a unique and novel stud member in conjunction with a base member which will result in easy sizing and accessibility of unused socket pieces of a socket set.

SUMMARY OF THE INVENTION

The principal objects of the present invention are provided by the present wrench socket holder and storage rack comprising a plurality of stud members registrable with a base member. Each stud member has basically three contiguous sections comprising two side sections and a top section hingedly connected from one side section to one edge of the top section and then from the other edge of the top section to the second side section. When the sides are positioned adjacent to one another, they form a stud having a substantially shaped square cross section. The interior surfaces of each side section of the stud member have a transverse bore, however, in one side section of the stud member, the bore is substantially completely through sufficient to allow a portion of a ball component to protrude therefrom yet be retained therein, while the second side section bore is partially therethrough, and along the same axis as the bore of the first side section, sufficient to house a coil spring member therein such that that member may be biased against the ball component when the sides are adjacent one another. Further, the respective interior surfaces of the side sections have matable detent and recess means to releasably lock each of the side sections together resulting in a stud member having the substantially square shaped cross section heretofore mentioned. The base of the stud member, and, thus, the base of each of the two side sections thereof, comprises a substantially "C" shape resulting in a groove that is matable with a channeled tongue of a base member rack that is also cross sectionally "C" shaped. A plurality of the stud members are, respectively, each capable of mating with, and retaining, individually, a plurality of wrench sockets.

BRIEF DESCRIPTION OF THE DRAWINGS

In order to more fully appreciate the present invention, its objects and features can be better understood from the following illustrations of a preferred embodiment of the present invention, taken in connection with the description and claims, wherein:

DESCRIPTION OF THE PREFERRED EMBODIMENT

Figure 1:
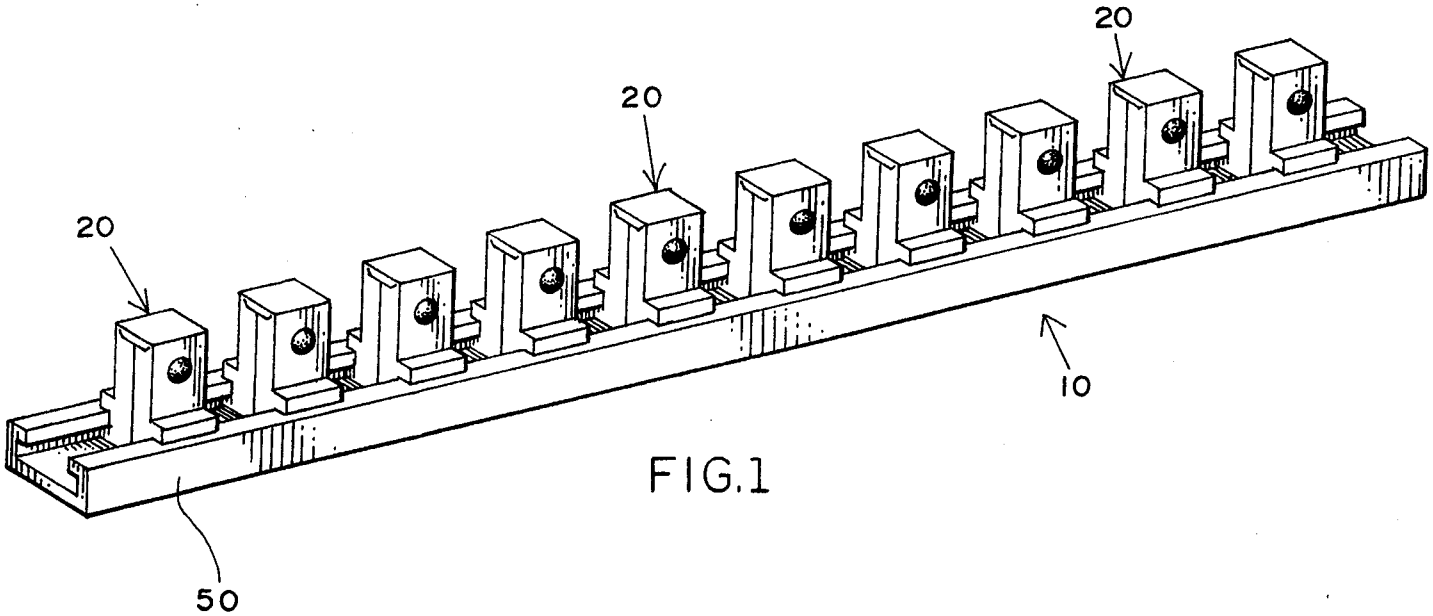
FIG. 1 is a perspective view of the present invention with channeled base member.

Referring now to the drawings, a wrench socket holder and storage rack is illustrated in FIG. 1. More particularly, the storage rack 10 is comprised of a stud member 20 and a channeled base member 50. The stud member 20 is preferably manufactured of a synthetic resin as is the base member 50. A suitable synthetic resin is polyvinyl chloride.

Figure 3:
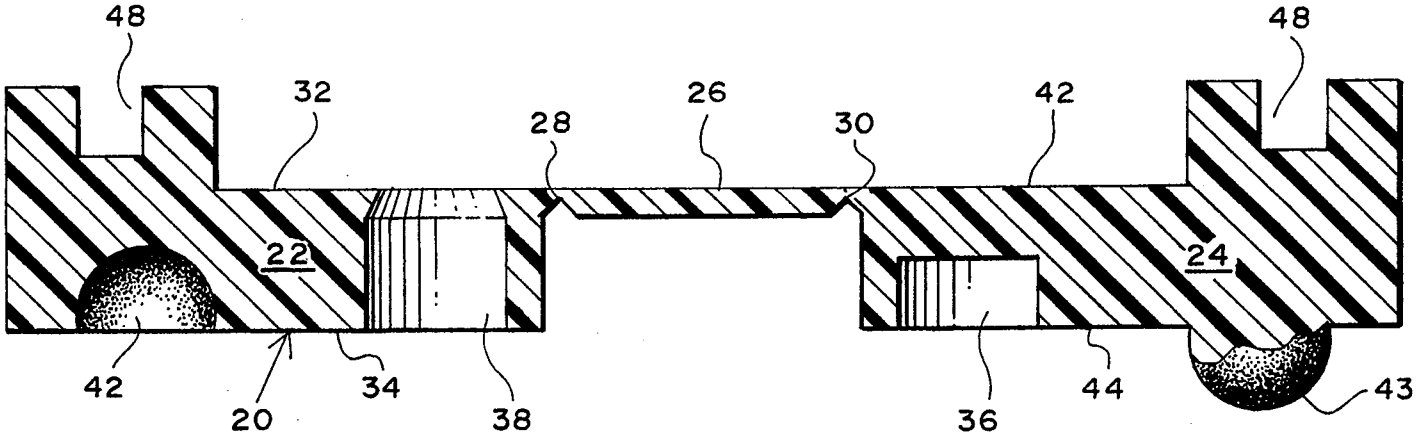
FIG. 3 is a cross section view of the stud portion of the present invention taken at line A—A of FIG. 2.
Figure 2:
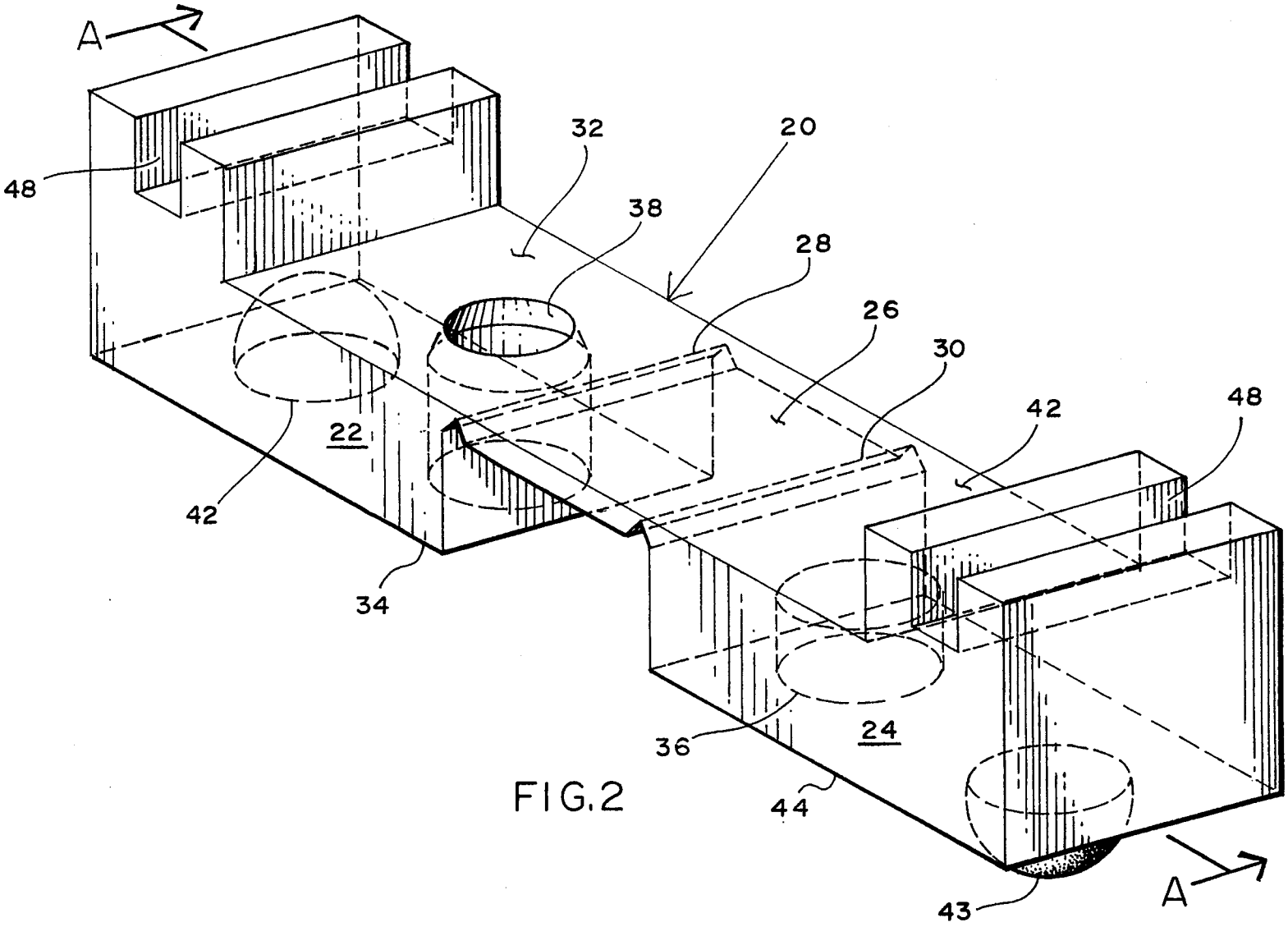
FIG. 2 is a transparent, perspective view of the stud portion of the present invention.

Directing the reader's attention more specifically to the stud member 20 of the present invention, FIGS. 2 and 3 illustrate its configuration. The stud 20 is comprised basically of three sections: two side sections, 22 is a first side section and 24 is a second side section, and a top section 26. The stud 20 is one contiguous piece of material, hereinabove disclosed. The first side section 22 has an upper edge 28 which is outwardly positioned with respect to the stud 20 as a whole and is part and parcel to the edge of the top section 26. Similarly, the second side section 24 has an upper edge 30 which is outwardly positioned with respect to the stud 20 as a whole which is part and parcel to the edge of the top section 26. Thus, the side sections 22 and 24, respectively, and the top section 26 of the stud 20 are contiguous with respect to one another such that the first side section 22 has an upper edge 28 which forms a part thereof, and is connected therewith, to the edge of the top section 26, which opposite edge thereof forms, and is connected with, the upper edge 30 of the said second side section 24. The resultant configuration is an interrelationship of the three components hingedly connected, in serial form, from the first side section 22 to the top section 26 to the second side section 24. It is preferred to have a 90 degree cut on the underside of the respective edges 28 and 30 so that when the side sections 22 and 24 are placed adjacent to one another, a substantially solid, square shaped stud member 20 cross section is formed. This 90 degree cut also permits the respective side sections to become adjacent, and touch, one another along their entire interior surfaces below described.

The side section 22 has an exterior surface 32 and an interior surface 34. The side section 24 has an exterior surface 42 and an interior surface 44. Each interior surface 34 and 44 respectively has a transverse bore along the same axis of each side section 22 and 24 respectively, such that the bores align when the side sections are adjacent one another.

Figure 4:
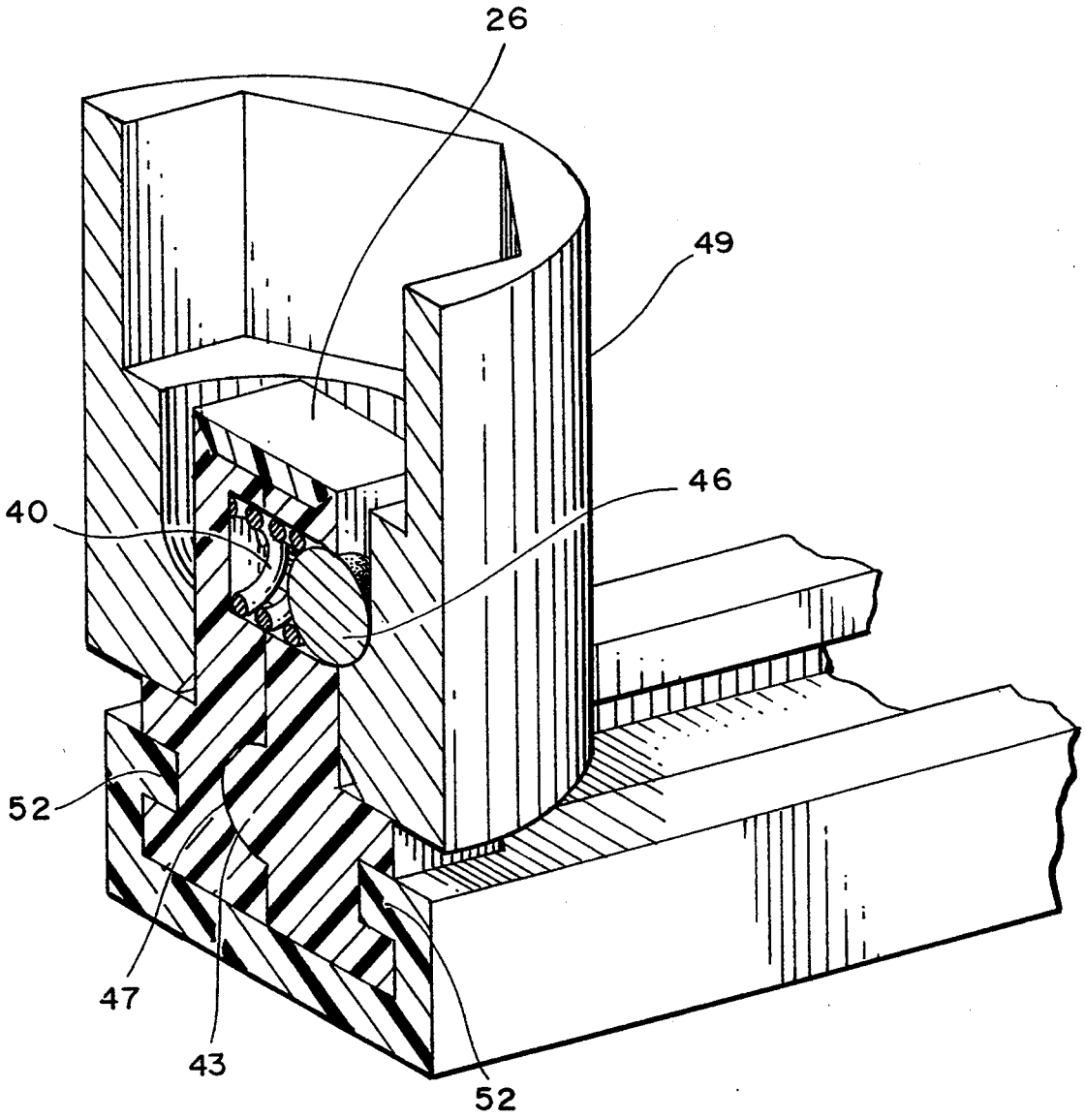
FIG. 4 is a cross sectioned, fragmented, perspective view of the present invention showing the channeled base member with a wrench socket head member shown.

Tranverse bore 36 is incomplete such that the exterior surface 42 of side section 24 does not exhibit the bore 36. This can be seen clearly in FIGS. 2 and 3. Therein the bore 36 rests a coil 40 of matable dimension with the bore 36 (FIG. 4.). The side section 22 has a tranverse bore 38 that is exposed on both the interior surface 34 of side section 22 and its exterior surface 32. However this bore 38 has a diameter slightly larger at the interior surface 34 then the exterior surface 32 such that a detent ball 46 that has a registrable diameter with that of the bore 38 at the interior face 34 may be permitted to ingress at the interior surface 34 of the bore 38 yet not completely egress at the exterior surface 32. Thus the ball 46 may protrude from the exterior surface 32 of the side section 22 while being retained therein by the tapered end of bore 38.

The stud member 20 may be manipulated to form a substantially square shaped cross section. This is done, in practice, by placing a coil 40 into bore 36 and placing a ball 46 into bore 38 at the interior surface 34 of side section 22. Matable detent 43 and recess 47 means along the interior surfaces 44 and 34, respectively, permit the closure of the side sections 22 and 24 to be releasably locked into a stud member 20 having the squared cross section. The coil 40 biases the ball 46 to protrude from the exterior surface 32 of side section 22 to engage the head of a socket 49 seen in FIG. 4.

The coil 40 and ball 46 work in tandem and in registration with the stud member 20 when its side sections 22 and 24, respectively, are adjacent one another to detachably position a socket thereover. However, this novel stud member 20 can be manufacturered, without the bores 36 and 38 and coil 40 and ball 46, but with a specific dimension so that a socket can be positioned thereover and be releasably attached to the stud member 20 using a pressure fit.

Each side section 22 and 24, respectively, also has bottom comprising a "C" shape and forming a groove 48. The base member 50 is an elongated channel comprising a "C" shaped cross section and forming a tongue 52 which is registrable with the respective grooves 48 of the side sections 22 and 24. The square shaped cross section stud member 20, or plurality thereof, may then be mated with the base member 50 thus forming the storage rack 10.

The foregoing figures and description hereof are provided as illustrative of the preferred embodiment of the concepts of this invention. While this embodiment represents what is regarded as the best mode for practicing this invention, it is not intended as limiting the scope of the invention which is set forth in the following claims.

What I claim is:

1. A holder and storage rack for wrench sockets, comprising:

a base member, a plurality of stud members slidably mountable onto said base member, each of said stud members comprising a first side section having a front surface and a back surface, said back surface having a partial transverse bore going through said back surface, a top section, and a second side section having a front surface and a back surface, said second side section having a full transverse bore therethrough which is along the same plane as the bore of the first side section, said second side section bore having an opening larger at the back surface than the front surface thereof, said first side section, top section and second side section being contiguously and hingedly connected in series such that in use, said first side section, top section, and second side section are folded together to define one of said stud members wherein the stud member is of a shape having a substantially square cross-section where the back surfaces of the first and second side sections are in direct physical contact, and means for holding a socket in a detachable position over said stud member, said means comprising a ball seated within the bore of said second side section, and a coil seated within the bore of the first side section to bias the ball outwardly so as to protrude from the front surface of the second side section of said stud member, the opening of said bore being of sufficiently small diameter with respect to the diameter of the said ball to prevent escape of said ball through the said side section.

2. In the apparatus of claim 1, means for locking the said side sections together when said stud member forms the substantially square cross-section, said means comprising a detent located on the back surface of said first side section and a recess located on the back surface of said second side section, said detent and recess being releasably matable.

3. In the apparatus of claim 2, said stud members being manufactured of a resilient, synthetic resin.

4. A holder and storage rack for wrench sockets, comprising:

a base member, a plurality of stud members slidably mountable onto said base member, each of said stud members comprising a first side section having a front surface and a back surface, a top section, and a second side section having a front surface and a back surface, said first side section, top section and second side section being contiguously and hingedly connected in series such that in use, said first side section, top section, and second side section are folded together to define one of said stud members wherein the stud member is of a shape having a substantially square cross-section where the back surfaces of the first and second side sections are in direct physical contact.

5. In the apparatus of claim 4, means for locking the said side sections together when said stud member forms the substantially square cross-section, said means comprising a detent located on the back surface of said first side section and a recess located on the back surface of said second side section, said detent and recess being releasably matable.

6. In the apparatus of claim 5, said stud members being manufactured of a resilient, synthetic resin.

* * * * *